United States Patent [19]

Herron et al.

[11] 4,071,095

[45] Jan. 31, 1978

[54] METHODS OF AND APPARATUS FOR WINNING REEF

[75] Inventors: Lorne Robert Herron, Benoni, South Africa; Axel Stromnes, Borlange, Sweden

[73] Assignee: Atlas Copco Aktiebolag, Nacka, Sweden

[21] Appl. No.: 679,683

[22] Filed: Apr. 23, 1976

[30] Foreign Application Priority Data

Apr. 23, 1975 South Africa ..... 75/2609

[51] Int. Cl.[2] ..... B23Q 5/00

[52] U.S. Cl. ..... 173/152; 299/23

[58] Field of Search ..... 173/152, 52, 1, 37, 173/38, 39, 42, 45; 299/22, 23, 20, 10, 15, 13; 125/1, 3, 4; 408/42, 43, 44, 24, 25

[56] References Cited

U.S. PATENT DOCUMENTS

| | | | |
|---|---|---|---|
| 1,273,869 | 7/1918 | Joy | 299/23 |
| 2,698,169 | 12/1954 | Fawkes | 173/37 |
| 2,754,100 | 7/1956 | Cartlidge | 299/23 |
| 3,321,032 | 5/1967 | Jensen et al. | 173/52 |
| 3,717,379 | 2/1973 | Fletcher et al. | 299/22 |
| 3,758,160 | 9/1973 | Hilton | 299/15 |
| 3,805,899 | 4/1974 | Hicks et al. | 173/45 |
| 3,877,373 | 4/1975 | Bergmann et al. | 299/13 |
| 3,912,024 | 10/1975 | Richmond et al. | 173/152 |

*Primary Examiner*—Robert Hafer

*Attorney, Agent, or Firm*—Flynn & Frishauf

[57] ABSTRACT

A reef winning machine comprises a frame on which is mounted a saddle. The saddle carries a boom on which is mounted a drill. The saddle also carries a member on which is carried a mechanical rock splitter. The drill and rock splitter operate simultaneously, the latter acting in a hole that had previously been drilled by the rock drill. A jack moves the saddle along the frame in steps that are the same as the distance between the drill and rock splitter. An impact breaker may be used instead of a rock splitter.

14 Claims, 5 Drawing Figures

METHODS OF AND APPARATUS FOR WINNING REEF

This invention relates to methods and apparatus for winning reef.

The most widely used way of winning reef is to drill holes in a stope face and then to insert explosives which blast the reef and also all surrounding waste rock from the stope face. Such means of winning reef is non-selective and also has many other disadvantages as are well known to those skilled in the art. To date however this manner of winning reef has not been replaced because its advantages outweigh the disadvantages. However with rising costs of ore processing, more selective mining methods are proving desirable. Further it is desirable for non explosive means to be used in winning reef.

SUMMARY OF THE INVENTION

According to one aspect of the invention there is provided a method of winning reef comprising drilling holes in upper and lower aligned rows, inserting a rock breaker means into one hole and simultaneously breaking the rock while drilling an adjacent rock in the row, repeating the operation on the hole below and then removing the cracked and loosened reef. The holes of each pair preferably span the reef and are preferably located one above the other. The upper and lower holes are preferably aligned.

The removal of reef preferably takes place using an impact breaker although under certain circumstances it can be done by barring or the reef may spall out.

The holes are preferably drilled with their axes parallel.

According to another aspect of the invention there is provided a reef winning machine comprising a frame, means for fixing the frame in position in a stope, a saddle on the frame, moving means moving the saddle along the frame, a first boom carried by the saddle, a rock drill mounted on the boom, means to advance the rock drill forwardly on the boom, tool carrying means carried by the saddle and rock breaker means mounted on the tool carrying means and operating simultaneously with the rock drill. The rock breaker means may comprise an hydraulic splitter having a tool which expands in a hole or alternatively an impact breaker.

BRIEF DESCRIPTION OF THE DRAWINGS

Two embodiments of the invention will now be described by way of example with reference to the accompanying drawings, in which.

DETAILED DESCRIPTION

Figure 1:
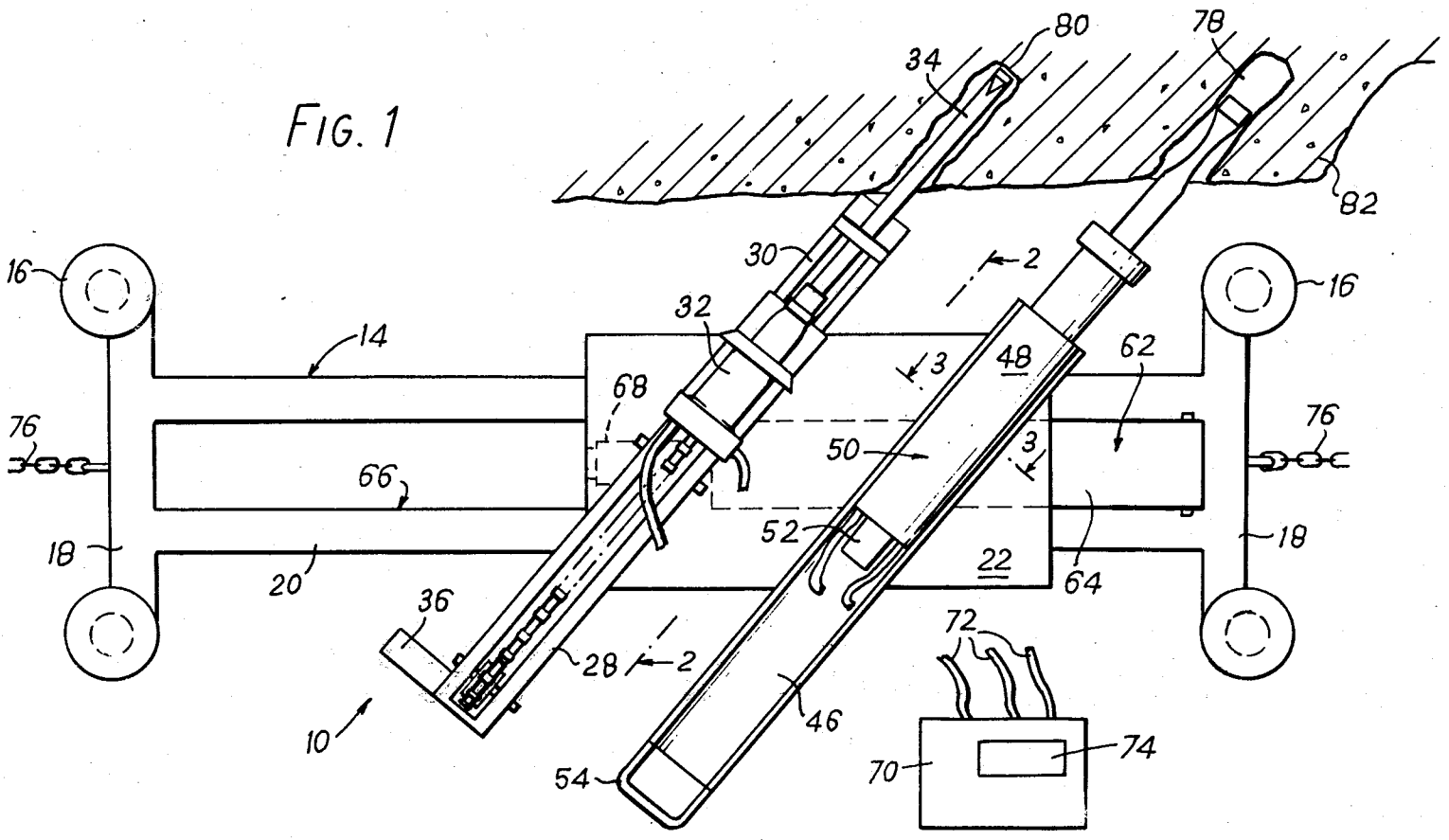
FIG. 1 is a plan view of a reef winning machine of the invention in a stope.
Figure 2:
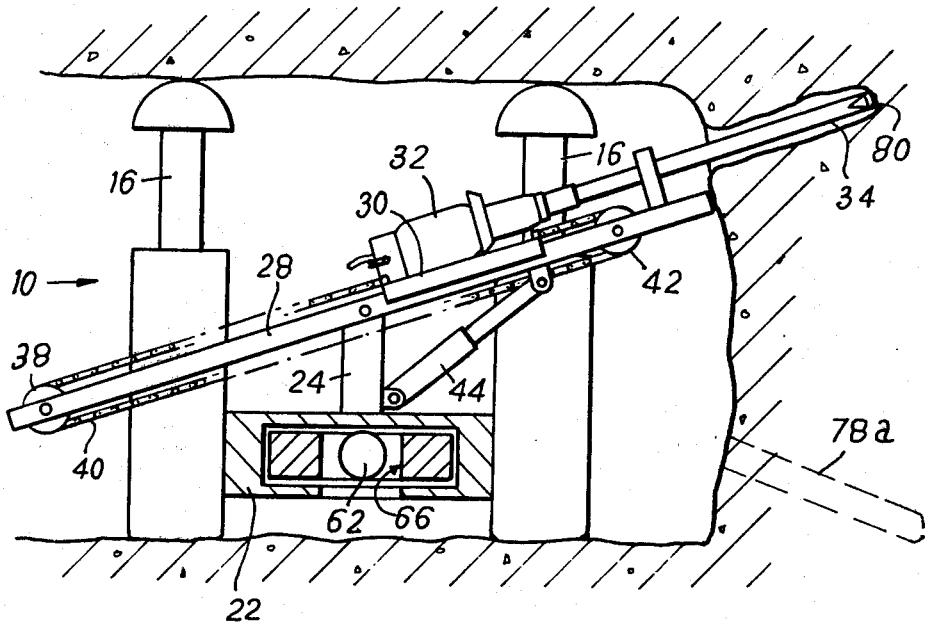
FIG. 2 is a section on line 2—2 of FIG. 1.

Referring now to FIGS. 1 and 2, there is shown a reef winning machine 10 of the invention. The machine 10 comprises an "I" shaped frame 14 having spragging jacks 16 at the ends of the cross members 18. The web part 20 of the frame 14 comprises a guide way for a saddle 22 which is slideable between extreme positions determined by the locations of the spragging jacks 16.

Midway along its width and located inwardly from its ends, the saddle 22 carries two upright members 24 and 26. Pivotally mounted on the upper end of the upright member 24 is a first boom 28 which can swing upwardly and downwardly about the pivot connection but is not able to swing about a vertical axis. The boom 28 has mounted thereon a rock drill saddle 30 carrying a rock drill 32 with the drill steel 34.

An air motor 36 mounted at the rear end of the boom 28 moves saddle 32 through a chain and sprocket arrangement (comprising driven sprocket 38, chain 40 and idler sprocket 42). A jack 44 extending between the base of the upright member 24 and near the front end of the boom 28 is arranged to adjust the inclination of the boom 28 relative to the saddle 22.

Figure 3:
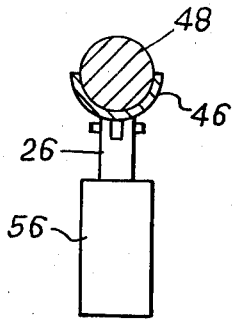
FIG. 3 is a section on line 3—3 of FIG. 1.

The other upright 26 pivotally carries a support bed 46 which has the section of the arc of a circle (see FIG. 3). The cylinder 48 of a mechanical wedge rock splitter 50 rests in the bed 46. The rock splitter 50 is of a construction as described in South African Patent Specification No. 74/3516 in the name of Helmut Darda which was based on German Patent Application P 23 36 063.6 filed on July 16, 1973. Rock splitter 50 is freely received within the bed 46 and slides axially thereon. The rock splitter 50 has a handle 52 at its rear end and the bed 46 also has a handle 54 at its end. The upright member 26 is not secured to the saddle 22 directly but is connected thereto through a compressable spring device 56 (see FIG. 3) which may be a spring but is preferably as shown, an hydraulic jack.

As mentioned above, the saddle 22 is slideable on the web 20 of the frame 14. In fact, as shown in FIG. 2, the saddle 22 virtually wholly embraces the web 20. The web 20 is hollow and contains an hydraulic jack 62. This jack has its cylinder 64 pivotally secured to the web 20 at one end of the aperture 66 therein and its piston rod 68 secured to the remote end of the saddle 22. By extending the jack 62, the saddle 22 can be made to traverse the frame 14.

Power for the jack 44, the rock drill 32, and the splitter 58 is supplied by a hydraulic power pack 70 which is connected to the aforegoing by hoses 72. The power pack 70 also includes a master cylinder 74 which is connected in the supply line of the jack 60 to supply measured amounts of hydraulic fluid thereto. In this way the jack 60 will index the saddle 22 or in other words the jack will move saddle 22 through steps of predetermined length. The length of these steps is the same as the distance between the upright members 24 and 26.

The frame 12 has chains 76 connected to its front and rear ends. Chains 76 are connected to winches or the like (not shown) which are operable to move the rock cutting machine along the stope face.

The machine 10 is operated as follows:

The frame 14 is moved into a desired location and then spragged into position by spragging jacks 16. The inclination of the boom 28 is set in an upward direction by the jack 44. The drill 32 is operated and the drill steel 34 drills a first upper hole 78 into the rock, being pushed thereinto by the air motor 36.

The drill saddle 30 is now retracted thereby withdrawing the drill steel from the hole 78. The inclination of the boom 28 is changed and a first lower hole 78*a* is drilled downwardly. The drill steel 34 is withdrawn. The main saddle 22 is then indexed forward. The projecting shank of the rock splitter 50 is inserted into the first upper hole 78. The boom 28 is moved to its upward position and the rock drill 32 commences drilling the second upper hole 80 substantially parallel to the first hole 78. Simultaneous operation of the rock splitter 50 now takes place breaking off the exposed rock 82.

The movement of the cylinder 48 of the rock splitter 50 during the rock breaking operation is not consistent or predictable and the mounting of the bed 46 on the jack 56 is intended to accommodate downward movement of the cylinder. Upward and sideways movement of the cylinder 48 will be free and unencumbered by the bed 46. It will therefore be appreciated that the machine operator must pay particular attention to the rock splitter and must return it manually to the bed 46 after operation. Further, the operator must both withdraw the splitter 50 manually and advance it along the bed 46 by means of the handle 52 using handle 54 to position the bed 46 and hence the splitter 50 prior to insertion into the hole 78.

After the second upper hole 80 has been drilled and the rock about the first hole 78 is broken away, the rock drill 32 and splitter 50 are withdrawn. The inclination of the boom 28 and the bed 46 is changed so that the shank of the splitter 50 is inserted into the first downward hole **78*a*** and at the same time a second lower hole parallel thereto is drilled.

The saddle 22 is now indexed forwardly and the operation repeated until the saddle 22 reaches the end of its traverse. The frame 14 is then advanced after despragging by the winches and the saddle is returned to its initial position. After re-spragging the reef winning operation continues. It will be seen that the two rows of holes (an upper row and a lower row) are drilled and these rows preferably span the reef. In this way either the entire rock face will be removed as two deep grooves will be formed and the rock therebetween can be barred out, removed by an impact breaker or otherwise entirely broken from the stope face. Further, it will be seen that a single operator can carry out substantial drilling operations so that the cost of labor can be materially reduced.

Figure 4:
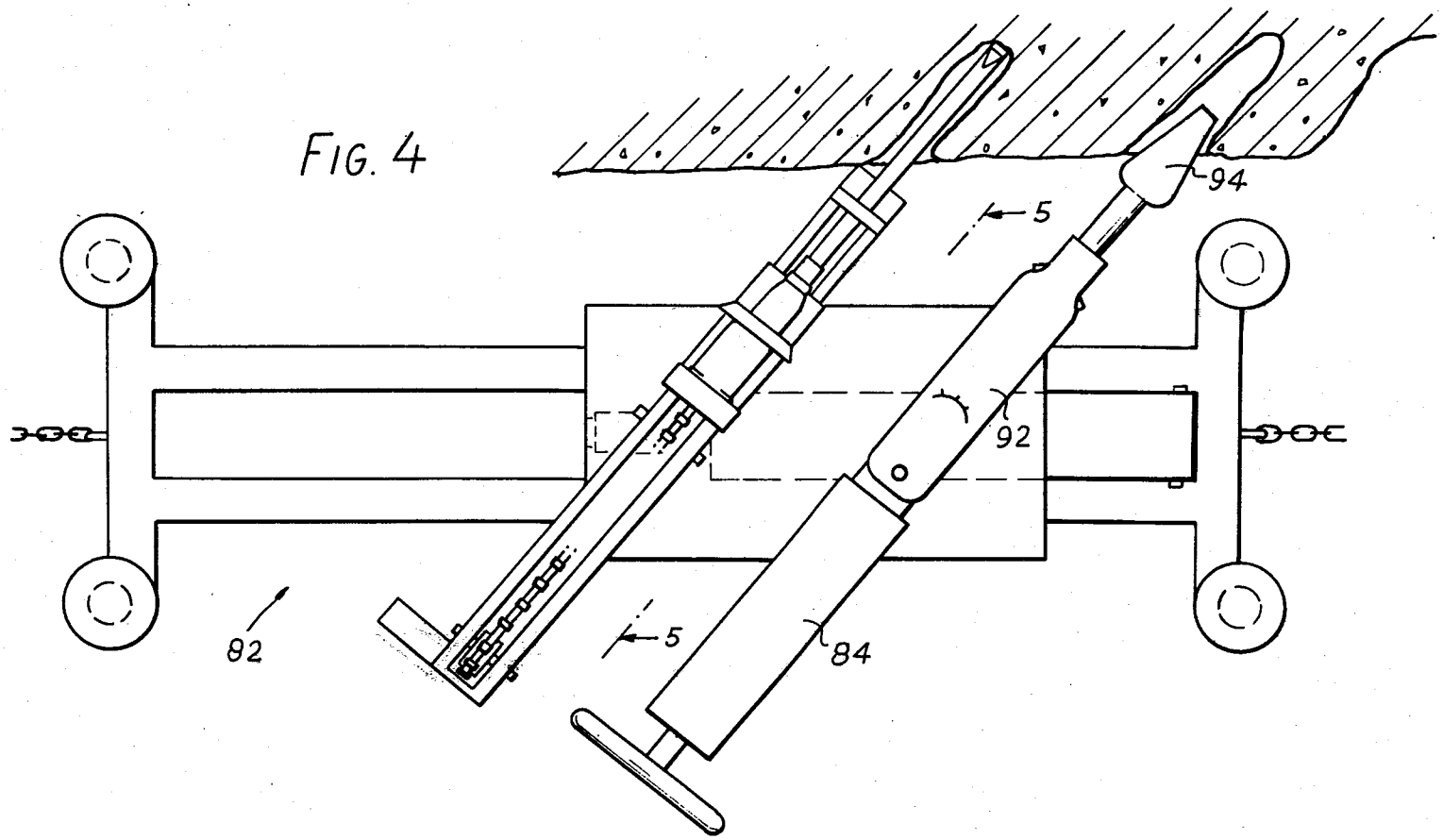
FIGS. 4 and 5 are views similar to FIGS. 1 and 2 of a modified reef winning machine of the invention in a stope.
Figure 5:
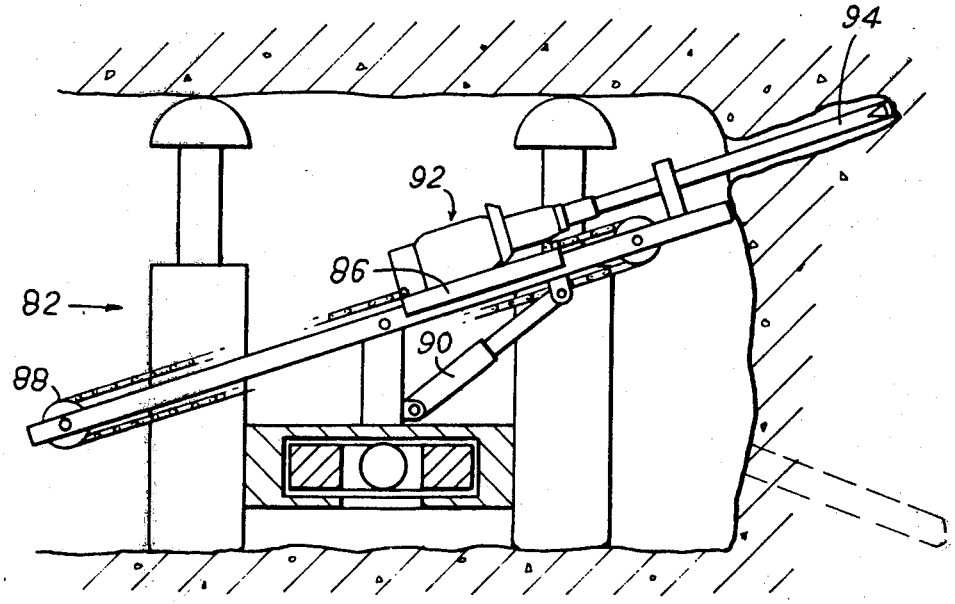

Instead of using a rock breaker 50 the machine may utilize a breaker having a breaker wedge as shown in FIGS. 4 and 5.

In such an arrangement the machine 82 has, instead of the bed 52, a second boom 84 provided with a saddle 86, air motor 88 and inclination jack 90 in the same way as the boom 28. Pavement breaker 92 is mounted on this second boom 84 in the same way as the rock drill 32 is mounted on the boom 28. This can be effected as the pavement breaker 92 does not swing about as does the rock splitter. The pavement breaker 92 carries a wedge 94 which enters into the hole (**78*a*** as illustrated) to break off the rock simultaneously with the drilling of the second hole.

The invention is not limited to the precise constructional details hereinbefore described and illustrated in the drawings. For example the inclination of the boom 28 and the bed 46 which are shown in plan to be inclined at about 30 degrees to the stope face may be inclined at any other angle or indeed may be perpendicular thereto.

Other means known to those skilled in the art may advance the saddles on the boom (or booms) and hydraulic or pneumatic means may be used as desired.

We claim:

1. A reef winning machine comprising:

a frame, means for fixing the frame in position in a stope, a saddle on the frame, moving means coupled to the saddle for moving the saddle along the frame, the moving means including a hydraulic jack coupled to the saddle and means for supplying measured amounts of hydraulic fluid to the hydraulic jack so that the hydraulic jack moves the saddle in substantially equal steps, a first boom carried by the saddle, a rock drill mounted on the boom, means coupled to the rock drill to advance the rock drill forwardly on the boom, tool carrying means carried by the saddle, and rock breaker means mounted on the tool carrying means and operating simultaneously with the rock drill.

2. A machine as claimed in claim 1 further comprising indexing means coupled to the moving means to move the saddle in substantially equal steps.

3. A machine as claimed in claim 1 in which the steps are of the same distance as the distance between the connection between the saddle and first boom means and the saddle and the tool carrying means.

4. A machine as claimed in claim 1 in which the rock breaker means comprises a mechanical wedge splitter.

5. A machine as claimed in claim 4 in which the tool carrying means comprises a bed on which the mechanical wedge splitter rests.

6. A machine as claimed in claim 5 in which the bed is non-rigidly connected to the saddle.

7. A machine as claimed in claim 1 in which the rock breaker is a pavement breaker using a wedge breaker to break the rock about the holes.

8. A machine as claimed in claim 7 in which the pavement breaker is mounted on a boom.

9. A method of winning reef comprising:

drilling holes in upper and lower aligned rows with a rock drill so as to span the reef, inserting rock breaker means into one hole and simultaneously breaking the rock while drilling an adjacent hole in the row, repeating the operations of inserting rock breaker means into a hole below said one hole and simultaneously breaking the rock while drilling an adjacent hole, laterally moving the rock drill and rock breaker by substantially equal intervals to a next position in one of said rows and drilling and inserting the rock breaker means for breaking rock while drilling a new hole, and then removing the cracked and loosened reef, whereby breaking is always performed in a lateral direction towards the standing laterally displaced broken-out free surface of the preceding breaking operation.

10. The method claimed in claim 9 in which the holes in the upper row are located above the holes in the lower row.

11. The method claimed in claim 9 wherein the holes are drilled with their axes parallel.

12. The method claimed in claim 10 in which the holes converge toward the stope.

13. A reef winning machine comprising:

a frame, means for fixing the frame in position in a stope, a saddle on the frame, moving means coupled to the saddle for moving the saddle along the frame, a first boom carried by the saddle, a rock drill mounted on the boom, means coupled to the rock drill to advance the rock drill forwardly on the boom, tool carrying means including a tool receiving bed carried by the saddle, and rock breaker means mounted on the tool carrying means and operating simultaneously with the rock drill, the rock breaker means comprising a mechanical wedge splitter resting on the tool receiving bed.

14. A machine as claimed in claim 13 in which the bed is non-rigidly connected to the saddle.

* * * * *

UNITED STATES PATENT AND TRADEMARK OFFICE

CERTIFICATE OF CORRECTION

PATENT NO. : 4,071,095
DATED : January 31, 1978
INVENTOR(S) : Lorne R. HERRON, et al It is certified that error appears in the above-identified patent and that said Letters Patent are hereby corrected as shown below:

On the initial page of the patent, change the inventor Herron's address to --Saltsjöbaden, Sweden--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*